United States Patent [19]

Bystedt

[11] 4,406,734

[45] * Sep. 27, 1983

[54] METHOD FOR THE MANUFACTURE OF MECHANICAL PULP

[75] Inventor: Hjalmar S. I. Bystedt, Enebyberg, Sweden

[73] Assignee: Sunds Defibrator AB, Stockholm, Sweden

[ * ] Notice: The portion of the term of this patent subsequent to Feb. 8, 2000 has been disclaimed.

[21] Appl. No.: 195,708

[22] Filed: Oct. 9, 1980

[51] Int. Cl.[3] ..... D21B 1/04

[52] U.S. Cl. ..... 162/23; 162/25; 162/26; 162/28; 162/56; 241/28

[58] Field of Search ..... 162/26, 27, 23, 24, 162/25, 56; 241/28

[56] References Cited

U.S. PATENT DOCUMENTS

| | | | |
|---|---|---|---|
| 3,125,306 | 3/1964 | Kollberg et al. | 241/298 |
| 3,808,090 | 4/1974 | Logan et al. | 162/26 |
| 4,247,363 | 1/1981 | Soma et al. | 162/28 |
| 4,283,252 | 8/1981 | Reinhall | 162/23 |

FOREIGN PATENT DOCUMENTS

| | | | |
|---|---|---|---|
| 2827038 | 8/1979 | Fed. Rep. of Germany | 162/23 |
| 2827039 | 8/1979 | Fed. Rep. of Germany | 162/23 |
| 45352 | 10/1911 | Sweden . | |

OTHER PUBLICATIONS

German Auslegeschrift 1010367, Published Jun. 13, 1957.

*Primary Examiner*—Peter Chin

*Attorney, Agent, or Firm*—Eric Y. Munson

[57] ABSTRACT

A method and a device for the manufacture of mechanical pulp from lignocellulosic material by forcing the said material into contact with a grindstone (1) which revolves about an axle (2). The material is supplied in bulk, particulate form, preferably as wood chips, a large number of particles simultaneously being retained, compressed and, in the presence of water, forced into contact with one or more grinding areas on the circumferential surface of the grindstone (1). The grindstone (1) is enclosed in a sealed, pressurized housing (5).

7 Claims, 3 Drawing Figures

METHOD FOR THE MANUFACTURE OF MECHANICAL PULP

The present invention is concerned with a method and a device for manufacturing mechanical pulp from lignocellulosic material by forcing the said material into contact with a grindstone which revolves about its axis.

In the usual method of preparing groundwood, logs crosscut to a given length are forced into contact with, usually, the circumferential surface of a revolving grindstone in the presence of water. The method gives a fairly short-fibred pulp which needs to be reinforced by the addition of chemical pulp in paper-making. Other methods of preparing mechanical pulp have been developed to increase the fibre length with the aim of reducing or eliminating the proportion of the more expensive chemical pulp. In chip refining, the wood is first chipped, and the chips are passed between two counter-rotating refiner discs, whereby they are comminuted to individual fibres. These are fibrillated by subsequent processing, and a long-fibred pulp wih good strength qualities is obtained. The method has been improved by allowing the process to proceed under steam pressure—thermomechanical pulping. By this method, chips—a cheaper raw material than round timber—can be used to prepare a pulp which can largely or completely replace even the chemical pulp component in newsprint and other wood-containing printing papers, cardboard etc. However, the method consumes more energy than groundwood.

Grinding under pressure has also been used to improve the quality of groundwood. This is reported to increase the fibre length and strength of the pulp without raising the energy consumption. The restriction of the method to round timber is, however, a disadvantage from the raw materials point of view, since one cannot use sawmill waste such as outside boards and edgings, small pulpwood, very crooked timber etc., as in the chip refining methods.

The purpose of the present invention is to prepare a mechanical woodpulp having a high content of long fibres and high strength with low energy consumption, which purpose is achieved by the characteristics in the claims set forth hereafter.

The invention is further detailed in the Claims and in the following description of an embodiment of the same in conjunction with the drawings.

Figure 1:
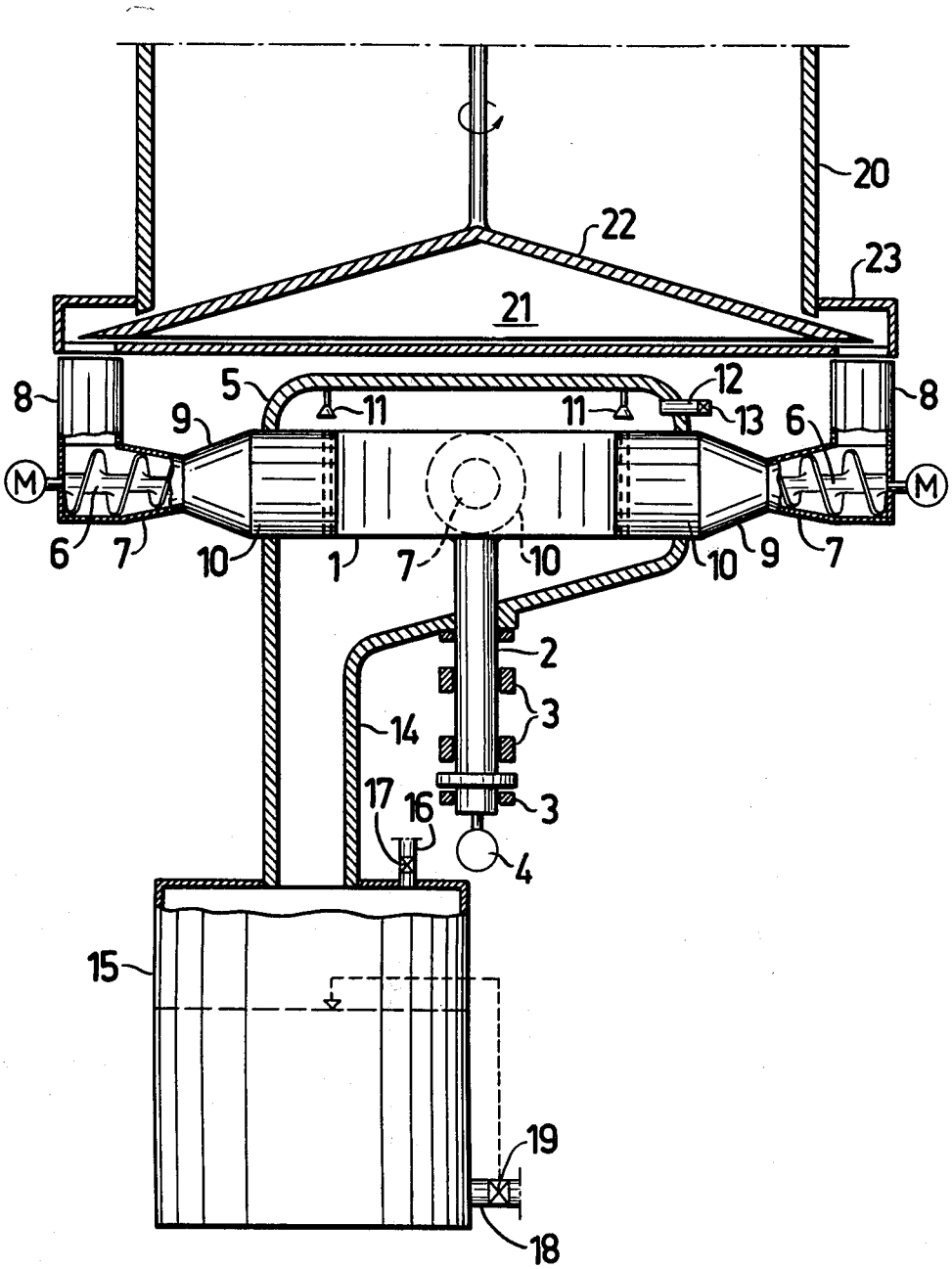
Figure 2:
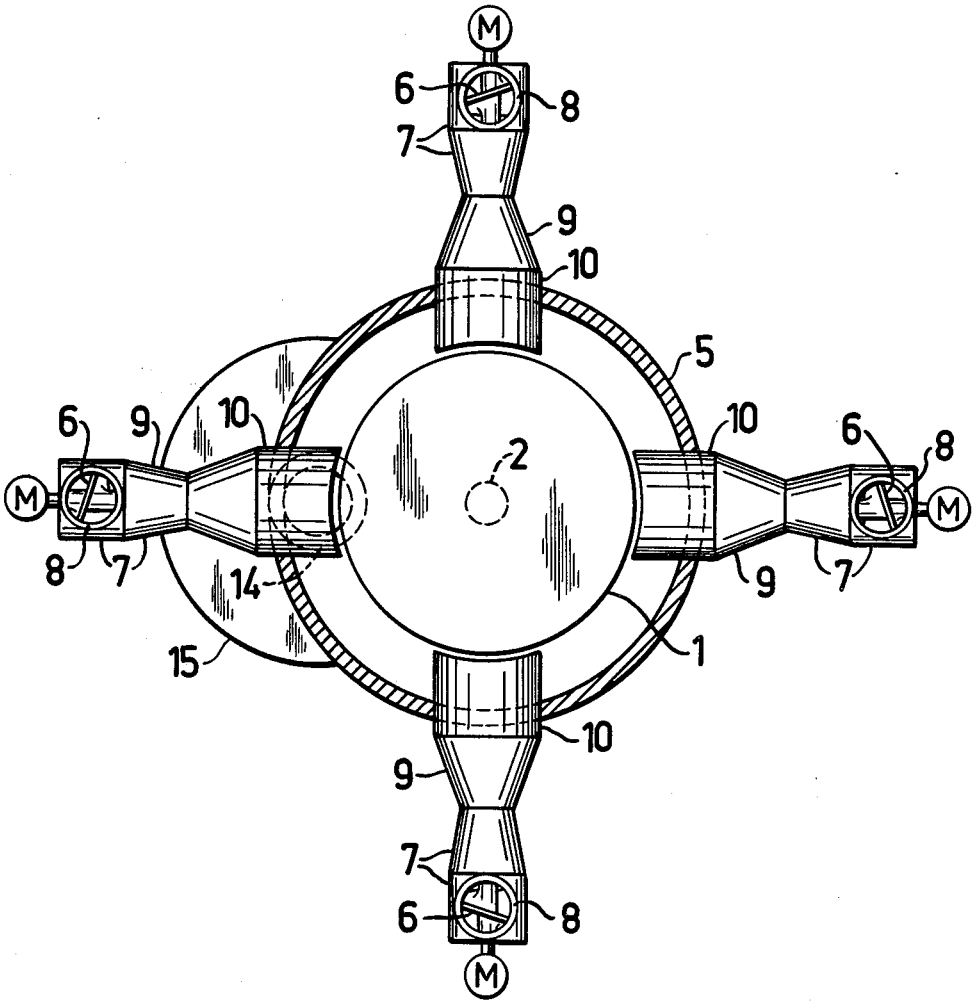
Figure 3:
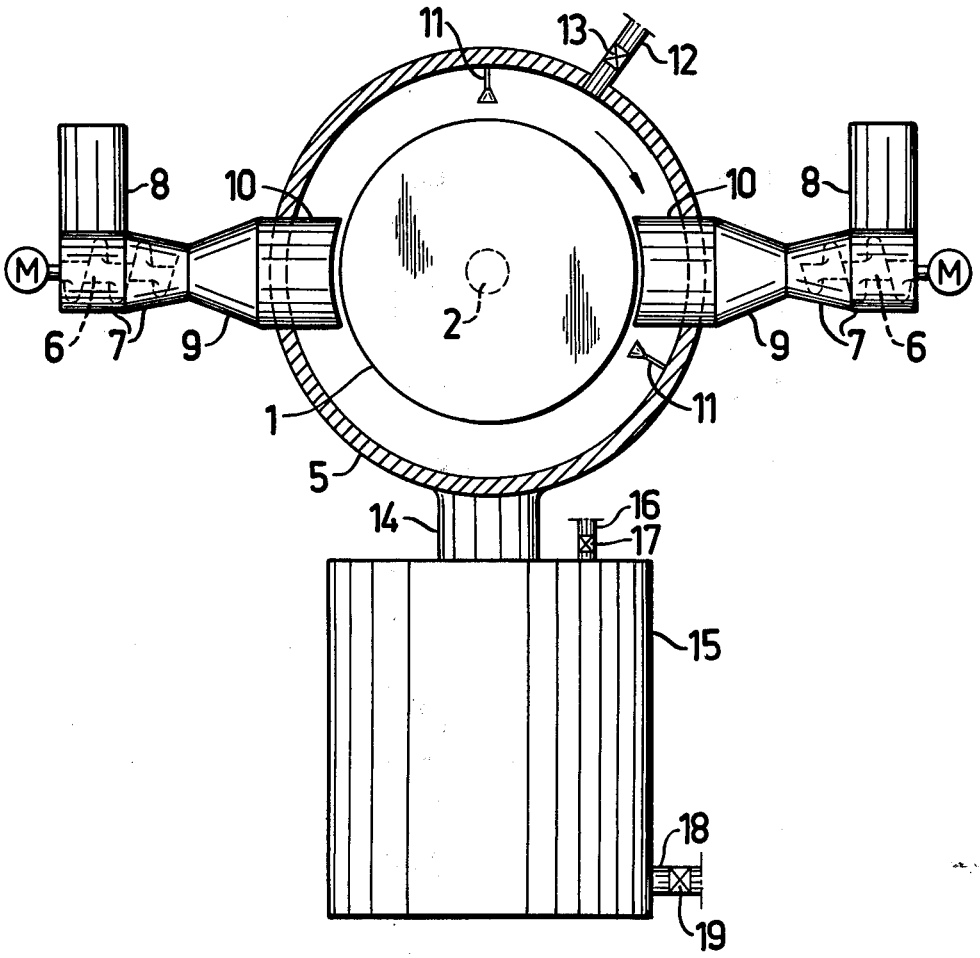

FIG. 1 shows a vertical section and FIG. 2 a horizontal section through a device for the implementation of the method of the invention. FIG. 3 is a vertical section of an alternative embodiment.

As illustrated in FIGS. 1 and 2, a cylindrical grindstone or grinding disc 1 is mounted on a vertical axle 2, which is supported in bearings 3 and caused to revolve by the motor 4. The grinding disc 1 is enclosed in a sealed, pressurized housing 5. Four screws 6, each having a cylindrical and a conical section, are arranged against the circumference of the disc. Each screw is enclosed in a screw pipe 7. Above the cylindrical section of the screw is a chute 8 in the form of a pipe of rectangular section. Each screw pipe 7 passes into an outer, conical plug tube 9 which flares towards the grinding disc 1 and passes into an inner, cylindrical plug pipe 10 which discharges through an opening in the housing 5 in the immediate proximity of the grinding disc. The screw 6 is caused to revolve by a variable-speed motor M. Jets 11 provided in the housing between the screws spray hot water onto the circumference of the disc. The housing 5 is moreover provided with a steam inlet 12 with a regulating valve 13. The housing slopes down towards an outlet 14 to a pressure tank 15, which is equipped with a steam outlet 16 with a regulating valve 17, and a stock outlet 18 with a regulating valve 19.

The chips are fed to the chute 8 and drop down into the screw 6. In the conical section of the screw the chips are compressed into a continuous steam-tight plug or short strand. The degree of compression is determined by the conicity of the screw. The plug is forced by the screw through the outer and inner plug tubes, 9 and 10 respectively, and into contact with the circumferential surface of the grinding disc 1. The wood is thereby ground to individual fibres and fibre fragments, which are diluted with water from the jets 11 and washed down into the bottom of the housing and through the outlet 14 to the pressure tank 15. From there the stock is blown through the outlet 18 and valve 19 to the atmosphere for further processing, such as screening, vortex cleaning etc. The valve opening 19 is controlled so as to maintain a certain stock level in the pressure tank.

The pressure inside the housing and the tank is maintained by the intake of pressurized steam through the steam inlet 12. The steam pressure is adjusted as desired by means of the regulating valve 13. Any surplus steam is blown through the steam outlet 16 and the regulating valve 17. The pressure inside the housing can be kept between 100 and 400 to 1,000 kPa absolute, the most suitable pressure being 150 to 250 kPa absolute, which corresponds to a temperature between 110° and 130° C. At this temperature the lignin in the wood bond softens, so that the fibres are separated in substantially undamaged condition. During grinding the chips are fixed with their fibres oriented in various directions, unlike the grinding of round timber, where the fibres are parallel to the grinding face, or chip refining, where the chips are free to move. However, the dimensions of the chips, which are longest in the direction of the fibres, will have the effect that when compressed and forced into contact with the grinding disc, the chips will "lie down", i.e. mainly assume an orientation with the fibres parallel to the direction of rotation of the grindstone. Hence the proportion of fibres ground while oriented perpendicular to the direction of rotation of the grindstone will be small, which naturally increases the content of long fibres. Another factor important to preserving the fibre length is the pressurized steam atmosphere. The combination of high humidity and high temperature thereby obtained promotes the freeing of the fibres. Other factors affecting the quality of the pulp are the quantity of water added, the texture of the disc, the speed of revolution of the disc, the pressure at which the plug of chips is forced against the grinding disc etc. The last-mentioned parameter is determined by the speed of the screw feeders, which is controlled by varying the speed of the motors M. When the speed of the screw is increased the contact pressure increases. The pulp is then coarser, i.e. the coarse and long fractions increase and the proportion of fines decreases. The resistance of the stock to dewatering is lower. At the same time, production increases and the load on the grinding motor is higher. The grindstone is usually built up of ceramic particles embedded in a binder. Different granular textures give different pulp qualities.

It is important that the inner plug tube discharges as close to the grinding surface as possible so that undefibred chip fragments cannot slip past and find their way into the stock. The inner plug tube is therefore made axially adjustable, so that it can be moved forward as the grinding surface of the stone wears down. It is known from the grinding of logs that fragments of wood primarily get into the stock when the contact pressure is released during the addition of fresh logs. During grinding, on the other hand, the wood is retained by the contact pressure. The risk of slivers entering the stock is, of course, still greater when the wood is supplied in the form of small chips. Hence it is a major advantage of the continuous plug feed that the contact pressure is never released. This also avoids the sudden drop in the output of the grinding motor, as it is running under constant load the whole time. It is further advantageous to control the speed of the screws so that the motor runs under constant, full load irrespective of feed variations due to changes in chip size, wood quality etc.

The chips may be fed to the chutes 8 from, for example, a cylindrical chip bin 20 located above the chute. The bin 20 has a base 21 of conical shape, elevated towards the centre, and with radially arranged arms 22. As the base slowly rotates, the chips are displaced towards the circumference into a circular gutter 23 positioned over the chutes 8 and provided with openings above them, so that the chips drop down into the chutes (so-called disc feeder).

The above-described embodiment of the method and the device for implementing the invention is only one example which can be varied in different ways within ther terms of the Claims. The axle of the grinding disc may be horizontal (FIG. 3) One, two or three grinding areas may be provided in various ways against the circumference of the disc. The chips may be conveyed to the grinding surface in different ways. The means for retaining, compressing and maintaining the contact pressure may be of another kind, e.g. pressure pistons or chains. The pressure in the housing can be maintained by a pressure medium other than steam, such as air or an inert gas. The grinding surface may be made of, for example, steel, cast iron, carbide alloy or similar material, with various raised and depressed patterns. The patterns may consist of raised ribs or rectangular projections forming channels or grooves between them and projecting at least 1–2 mm and preferably 3–5 mm from the grinding surface. To simplify the repair of worn parts of the grinding surface, the grinding means may be formed on a number of separate, replaceable cylindrical segments. The stock may be discharged from the pressurized housing in various ways.

The material can be pretreated in various ways, e.g. by impregnation with chemicals of various kinds for softening the fibre bond, adjusting the acidity (pH) or for bleaching purposes. The chemicals may also be added directly in the grinding step, preferably dissolved in the dilution water. However, the material must not be broken down by chemical or mechanical means so that it loses its character of distinct particles with the approximate dimensions given below. This form of aggregate is necessary in order for the material to be retained during grinding, in contrast to the case of refining.

Thus, the invention is concerned with a method and a device for the manufacture of mechanical pulp from lignocellulosic material, wherein the material in bulk form, consisting of a large number of particles, usually wood chips, in the presence of water, is retained against and forced into contact with at least one grinding area on the circumferential surface of a grindstone which revolves about an axle perpendicular to the end faces of the stone in a sealed, pressurized housing. A suitable particle size for the material to be used in implementing the invention is approx. 20–30 mm in length parallel to the fibres, approx. 10–20 mm in width, and approx. 5–10 mm in thickness, i.e. normal cellulose chips.

I claim:

1. Method for manufacturing mechanical pulp from lignocellulosic material in the form of chips by forcing the said material into contact with the circumferential surface of a grinding disc which revolves about an axis perpendicular to the opposing end faces of said grinding disc in a sealed pressurized housing, which method is characterized by first compressing the chips in the presence of water while passing them through an outwardly flared passage into a conical continuous steam-tight plug and thereafter passing said conical plug through a cylindrical passage connected to said outwardly flared passage to form an expanded straight cylindrical steam-tight plug, which expanded plug is maintained in forced contact with at least one grinding area on the circumferential surface of the grinding disc during the grinding operation and by adding water to the housing to wash the resultant fibers and fiber fragments from the grinding disc into the housing.

2. Method according to claim 1, characterized in that the pressure in the housing is maintained by means of steam.

3. Method according to claim 1, characterized in that the pressure in the housing is maintained by air or by an inert gas.

4. Method according to claim 1, characterized in that the pressure inside the housing is between 100 and 400 to 1000 kPa absolute.

5. Method according to claim 1, characterized in that the material is fed to the grindstone through one or more openings in the housing in the form of a continuous steam-tight plug or short strand.

6. Method according to claim 1, characterized in that the particles of the material, before or during grinding, are impregnated or otherwise exposed to chemicals to soften the fibre bond, to adjust the acidity (pH) or to increase the brightness.

7. Method according to claim 4, characterized in that the pressure inside the housing is between 150 and 250 kPa to 1000 kPa absolute.

* * * * *

UNITED STATES PATENT OFFICE

CERTIFICATE OF CORRECTION

Patent No. 4,406,734 Dated September 27, 1983

Inventor(s) Hjalmar S. I. Bystedt

It is certified that error appears in the above-identified patent and that said Letters Patent are hereby corrected as shown below:

On the title page add:

[30] Foreign Application Priority Data

October 10, 1979 [SE] Sweden . . . . . 7908412-5

Signed and Sealed this

Tenth Day of January 1984

[SEAL]

Attest:

GERALD J. MOSSINGHOFF

Attesting Officer

Commissioner of Patents and Trademarks